US009640860B2

(12) United States Patent
Iso et al.

(10) Patent No.: US 9,640,860 B2
(45) Date of Patent: May 2, 2017

(54) ANTENNA DEVICE

(71) Applicant: Hitachi Metals, Ltd., Tokyo (JP)

(72) Inventors: Naoki Iso, Hitachi (JP); Nobuaki Kitano, Hitachi (JP); Masahisa Kaneta, Hitachi (JP); Tomoyuki Ogawa, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 138 days.

(21) Appl. No.: 14/598,834

(22) Filed: Jan. 16, 2015

(65) Prior Publication Data

US 2015/0207221 A1 Jul. 23, 2015

(30) Foreign Application Priority Data

Jan. 21, 2014 (JP) ..... 2014-008774

(51) Int. Cl.
*H01Q 1/38* (2006.01)
*H01P 3/08* (2006.01)

(52) U.S. Cl.
CPC ..... *H01Q 1/38* (2013.01); *H01P 3/087* (2013.01)

(58) Field of Classification Search
CPC ..... H01Q 1/38; H01Q 1/50
USPC ..... 343/700 MS, 829, 846, 905
See application file for complete search history.

(56) References Cited

U.S. PATENT DOCUMENTS 4,538,153 A * 8/1985 Taga ..... H01Q 1/242 343/700 MS
5,414,434 A * 5/1995 Conant ..... H01Q 1/28 343/700 MS
6,157,344 A * 12/2000 Bateman ..... G06F 1/1616 343/700 MS
6,897,813 B2 * 5/2005 Higasa ..... H01Q 9/0435 343/700 MS
8,749,434 B2 * 6/2014 Han ..... H01Q 1/40 343/700 MS
9,172,135 B2 * 10/2015 Sudo ..... H01Q 1/38

FOREIGN PATENT DOCUMENTS

JP 63-088902 4/1988

* cited by examiner

*Primary Examiner* — Tho G Phan
(74) *Attorney, Agent, or Firm* — Roberts Mlotkowski Safran Cole & Calderon P.C.

(57) ABSTRACT

An antenna device includes a center substrate including a dielectric substrate and a center conductor on the dielectric substrate, and two ground plates sandwiching via an air layer the center substrate therebetween to form a feeder line. A hole is formed in the dielectric substrate on at least one side of the center conductor along a longitudinal direction of the center conductor.

6 Claims, 4 Drawing Sheets

ANTENNA DEVICE

The present application is based on Japanese patent application No. 2014-008774 filed on Jan. 21, 2014, the entire contents of which are incorporated herein by reference.

BACKGROUND OF THE INVENTION

1. Field of the Invention

This invention relates to an antenna device.

2. Description of the Related Art

An antenna device is known which uses as a feeder line a triplate line composed of a center conductor sandwiched between two ground plates so as to reduce a transmission loss in a feeder line and simplify the structure thereof (see e.g. JP-S63-88902).

SUMMARY OF THE INVENTION

The triplate line using a metal plate as the center conductor has the problem that the center conductor is divided into plural components so that much time and labor may be needed in assembling them. Thus, applicant of the invention proposes an antenna device configured to use as the center conductor a wiring pattern disposed on a dielectric substrate in a part of the feeder line.

The antenna device proposed may have the problem that in case of using a long feeder line or a high frequency, a transmission loss thereof increases due to the influence of the dielectric substrate. Thus, it is desired to be further improved.

In addition, a recent antenna device is needed to increase the density of the feeder line due to e.g. sharing of a frequency. Thus, even when the center conductors are densely wired, it is desired to keep a high isolation between adjacent center conductors.

It is an object of the invention to provide an antenna device that allows the reduction in transmission loss in a feeder line and the high isolation between adjacent center conductors even in case of densely wiring the center conductors.

(1) According to one embodiment of the invention, an antenna device comprises:

a center substrate comprising a dielectric substrate and a center conductor on the dielectric substrate; and two ground plates sandwiching via an air layer the center substrate therebetween to form a feeder line, wherein a hole is formed in the dielectric substrate on at least one side of the center conductor along a longitudinal direction of the center conductor.

In the above embodiment (1) of the invention, the following modifications and changes can be made.

(i) The hole comprises a through hole penetrating the dielectric substrate.

(ii) The hole is formed in the dielectric substrate on both sides of the center conductor along the longitudinal direction of the center conductor.

(iii) A distance between the center conductor and the hole is not more than a thickness of the dielectric substrate.

(iv) The hole is formed between adjacent ones of the center conductor, and wherein the distance between the center conductor and the hole is not more than 0.3 mm.

(v) The hole is not less than 4 mm in width.

(vi) The center conductor comprises a wiring pattern formed symmetrically on both surfaces of the dielectric substrate.

Effects of the Invention

According to one embodiment of the invention, an antenna device can be provided that allows the reduction in transmission loss in a feeder line and the high isolation between adjacent center conductors even in case of densely wiring the center conductors.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

The embodiments of the invention will be explained below in accordance with the attached drawings.

Figure 1A:
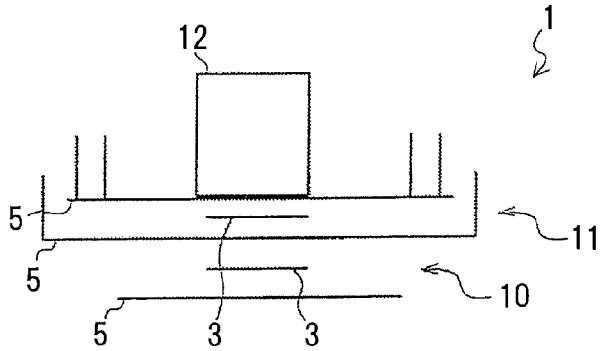
FIG. 1A is a cross-sectional view schematically showing an antenna device according to one embodiment of the invention.
Figure 1B:
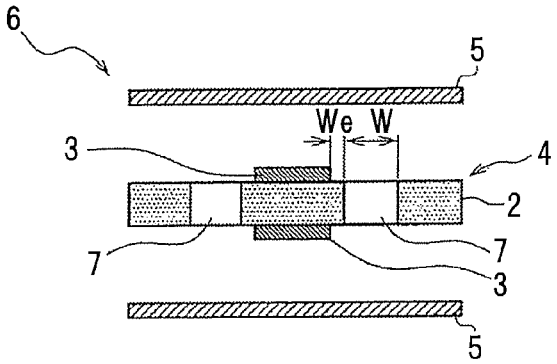
FIG. 1B is a cross-sectional view schematically showing a feeder line used in the embodiment.
Figure 1C:
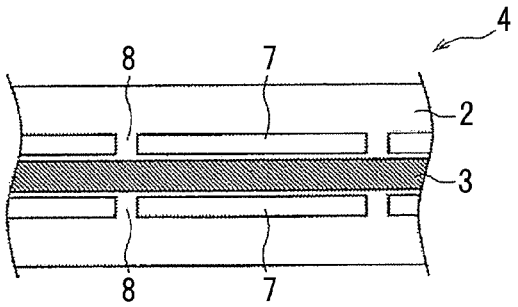
FIG. 1C is a plan view schematically showing the feeder line shown in FIG. 1B.

FIG. 1A is a cross-sectional view schematically showing an antenna device according to one embodiment of the invention, FIG. 1B is a cross-sectional view schematically showing a feeder line used in the embodiment and FIG. 1C is a plan view schematically showing the feeder line shown in FIG. 1B.

As shown in FIGS. 1A to 1C, an antenna device 1 includes a feeder line 6 configured such that a center substrate 4 constituted of a dielectric substrate 2 and center conductors 3 disposed on the dielectric substrate 2 is sandwiched between two ground plates 5 via air layers. The antenna device 1 is used as, for example, a base station antenna for mobile communication.

As the center conductor 3, it is preferred to use a conductor that is comprised of copper or a copper alloy having high conductivity. As the ground plate 5, it is preferred to use a plate that is comprised of aluminum having reduced weight and cost, and excellent weather resistance. As the dielectric substrate 2, it is preferred to use, for example, a glass epoxy substrate.

In the embodiment, the antenna device 1 is configured to have a double-layer structure that a phase shifter distribution line part 10 having a phase shifter and a distribution wiring and an in-block distribution line part 11 having lines configured to carry out a distribution wiring to each antenna element 12 are laminated with each other. The antenna device is configured such that a feeding signal supplied from the outside is transmitted from the phase shifter distribution line part 10 to each antenna element 12 via the in-block distribution line part 11.

Further, a specific structure of the antenna device 1 is not limited to this, but a single layer structure and a multilayered structure having not less than three layers may be used. In addition, a structure that a plurality of the phase shifter distribution line parts 10 are connected to the in-block distribution line part 11 perpendicularly thereto may be also used.

In the antenna device 1, a radome (not shown) having a cylindrical shape is disposed so as to cover the phase shifter distribution line part 10, the in-block distribution line part 11 and each antenna element 12, and a mounting metal fitting disposed in the radome is fixed to an antenna tower or the like, thereby the radome is mounted to the antenna tower or the like such that an axial direction of the radome (a direction perpendicular to the surface of paper in FIG. 1A) is placed in the vertical direction.

Then, in the antenna device 1 according to the embodiment, in at least a part of the feeder line 6, holes 7 are formed in the dielectric substrate 2 on at least one side of the center conductor 3 along the center conductor 3.

By forming the holes 7, an electric field passing through the dielectric substrate 2 is reduced so as to suppress an influence of the dielectric substrate 2, so that transmission loss due to the influence of the dielectric substrate 2 can be reduced. Even if the holes 7 are formed only on one side of the center conductor 3, the effect can be obtained, but in order to maintain a balance of the electric field, it is preferable that the holes 7 having the same shape are formed on both sides of the center conductor 3 along the center conductor 3.

In the embodiment, the holes 7 are constituted of through holes that penetrate the dielectric substrate 2. Further, the holes 7 can be holes that do not penetrate the dielectric substrate 2, but in case that the dielectric substrate 2 is thin, an influence of the dielectric substrate 2 left without being penetrated appears and hole processing becomes difficult, thus it is preferable that the holes 7 are constituted of through holes.

The holes 7 are formed along the center conductor 3 at a predetermined interval, and are configured such that the dielectric substrate 2 just below the center conductor 3 and the dielectric substrate 2 around it are connected to each other by sections 8 left between the holes 7 adjacent to each other. The interval of the holes 7 (the length of the sections 8) and the length of the holes 7 (the interval of the sections 8) can be appropriately configured in consideration with a wiring layout and the like, in addition, the interval of the holes 7 (the length of the sections 8) and the length of the holes 7 (the interval of the sections 8) are not required to be definite.

Furthermore, in the antenna device 1 according to the embodiment, the center conductor 3 is constituted of a wiring pattern formed symmetrically on both sides (the front surface and the rear surface) of the dielectric substrate 2. Namely, on both sides of the dielectric substrate 2, wiring patterns having almost the same shape overlapping each other in planar view (wiring patterns being almost symmetrical to a surface passing through the center in the thickness direction of the dielectric substrate 2) are formed, and the antenna device 1 is configured such that the wiring patterns formed on both sides of the dielectric substrate 2 are used as the center conductor 3. The wiring patterns formed on both sides of the dielectric substrate 2 are formed so as to have the same shape except for a part, such as a connection part to a connector, required to have a different shape for arrangement of wiring.

The wiring patterns formed on both sides of the dielectric substrate 2 are used as the center conductor 3, thereby the feeder line 6 has a structure that two inverted strip lines are arranged so as to sandwich the dielectric substrate 2, thus the electric field passing through the dielectric substrate 2 is reduced so as to further suppress an influence of the dielectric substrate 2, so that transmission loss due to the influence of the dielectric substrate 2 can be further reduced.

To the wiring patterns formed on both sides of the dielectric substrate 2 that become the center conductor 3, a common feeding signal is supplied. In order to compensate the asymmetry of the wiring patterns formed on the front surface and the rear surface, through holes that electrically connect the wiring patterns formed on the front surface and the rear surface can be appropriately formed. Further, if the wiring patterns formed on the front surface and the rear surface are perfectly symmetrical, electric current does not flow through the through holes electrically connecting the wiring patterns of the front surface and the rear surface.

Figure 2:
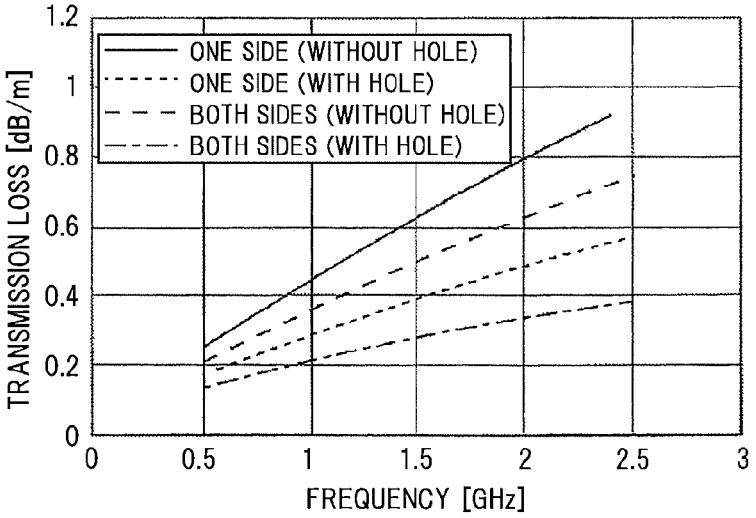
FIG. 2 is a graph showing that in the invention, transmission loss is changed due to the fact that holes are present or absent, and center conductors are formed on both sides of substrate or not.

As shown in FIG. 2, in comparison with a conventional example (one side (without hole)) configured such that the center conductor 3 is disposed only on one side of the dielectric substrate 2 and the holes 7 are not formed therein, the holes 7 are formed along the center conductor 3 (one side (with hole)) or the center conductors 3 are disposed on both sides of the dielectric substrate 2 (both sides (without hole)), thereby transmission loss can be reduced. In addition, it is known that the center conductors 3 are disposed on both sides of the dielectric substrate 2 and the holes 7 are formed therein (both sides (with hole)), thereby transmission loss can be most reduced.

The optimum conditions at the time of forming the holes 7 will be discussed below.

First, a distance (We) between the center conductor 3 and the holes 7 will be discussed below. The distance (We) between the center conductor 3 and the holes 7 means a protrusion amount of the dielectric substrate 2 protruding from the center conductor 3 in the lateral direction.

A simulation is conducted while changing the distance (We) between the center conductor 3 and the holes 7, where the center conductor 3 has a width of 4.8 mm, a thickness of 35 μm and conductivity of $2.09\times10^7$ S/m, the dielectric substrate 2 has a thickness of 0.8 mm, a relative dielectric constant of 4.3 and a dielectric tangent of 0.01, and the ground plate 5 has a distance of 5 mm and conductivity of $5.977\times10^7$ S/m. The simulation result is shown in FIG. 3.

Figure 3:
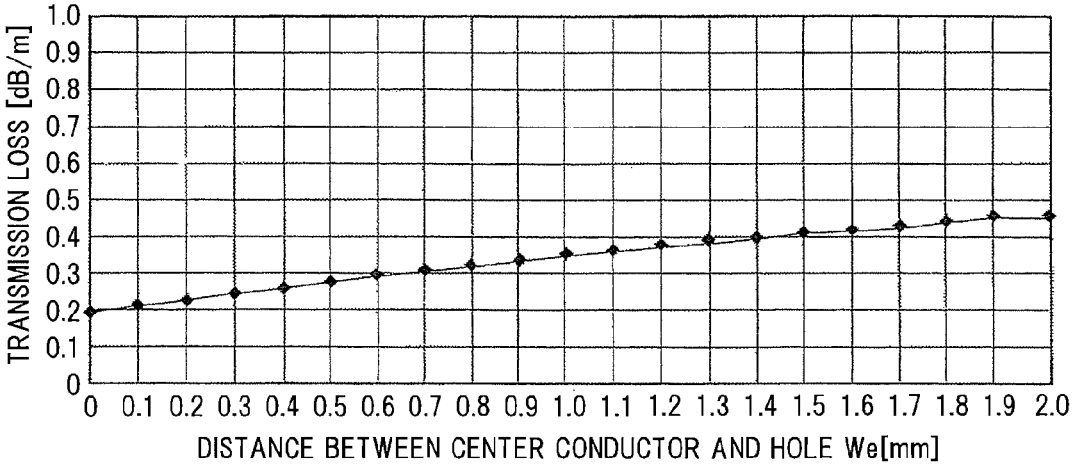
FIG. 3 is a graph showing an arithmetical operation result of transmission loss with respect to a distance between the center conductor and the hole in the invention.

As shown in FIG. 3, it is known that the more the distance (We) between the center conductor 3 and the holes 7 becomes large, the more the transmission loss becomes large. Consequently, in order to reduce the transmission loss, it is required that the distance (We) between the center conductor 3 and the holes 7 is reduced as much as possible. According to FIG. 3, the distance (We) between the center conductor 3 and the holes 7 is configured to be not more than a thickness of the dielectric substrate 2, thereby the transmission loss can be sufficiently suppressed.

Figure 4A:
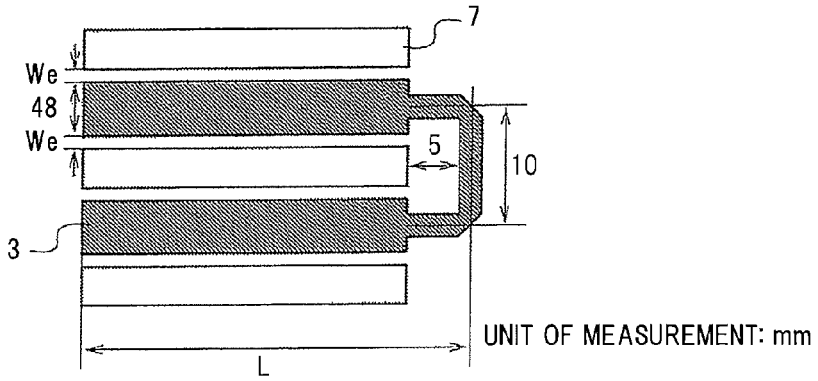
FIG. 4A is a plan view schematically showing a model at the time of the arithmetical operation.
Figure 4B:
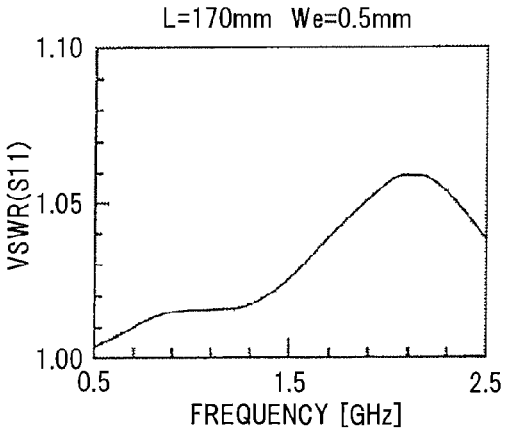
FIGS. 4B to 4E are graphs showing characteristics of VSWR with respect to a frequency when the arithmetical operation is carried out by using the model shown in FIG. 4A.
Figure 4C:
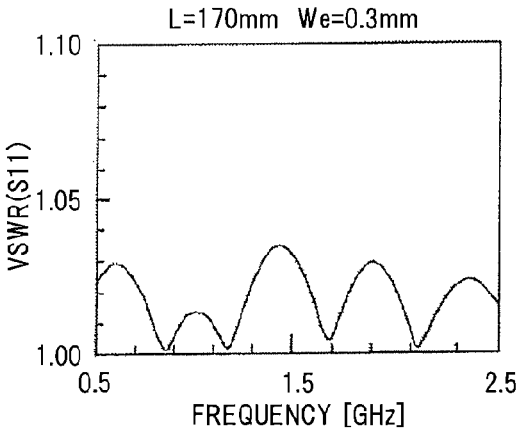
Figure 4D:
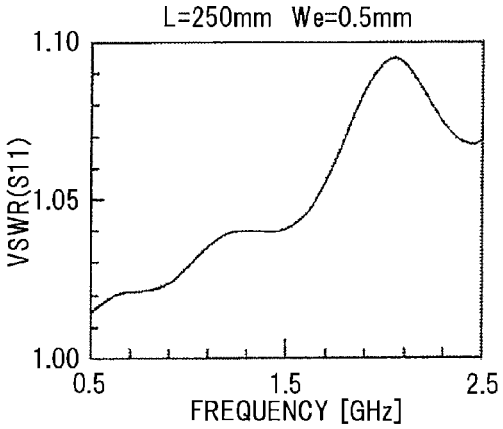
Figure 4E:
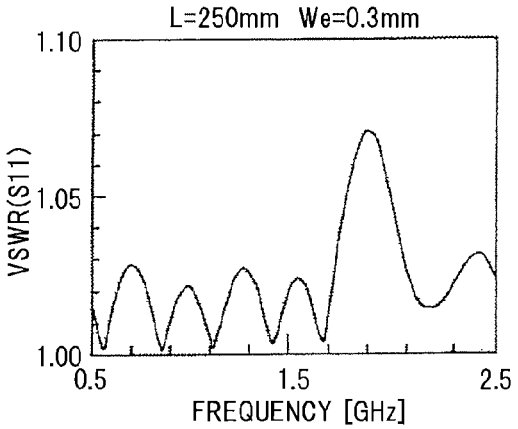

By the way, the holes 7 are formed between the center conductors 3 adjacent to each other, thereby isolation between the center conductors 3 adjacent to each other can be also heightened. Then, as shown in FIG. 4A, an analysis model is used, the model being configured such that the center conductor 3 having an almost U-shape rotated counterclockwise by 90 degrees is included and the holes 7 are formed in both side parts and the center part of the center conductor 3, and then a simulation was carried out while the length (L) of the center conductor 3 and the distance (We) between the center conductor 3 and the holes 7 were changed, and VSWR (Voltage Standing Wave Ratio, S11) was arithmetically operated. The simulation result is shown in FIG. 3. Further, the other conditions are similar to the case shown in FIG. 3. The result is shown in FIGS. 4B to 4E.

As shown in FIGS. 4B to 4E, in both cases that the length (L) of the center conductor 3 is configured to be 170 mm and 250 mm, it is known that a case that the distance (We) between the center conductor 3 and the holes 7 is configured to be 0.3 mm is improved in VSWR, in comparison with a case that the distance (We) between the center conductor 3 and the holes 7 is configured to be 0.5 mm. It is considered that this is due to the fact that bonding between the center conductors 3 adjacent to each other is reduced so that isolation between the center conductors 3 adjacent to each other is heightened.

Consequently, from the view point of heightening isolation between the center conductors 3 adjacent to each other, it is preferable that the distance (We) between the center conductor 3 and the holes 7 is configured to be not more than 0.3 mm.

Next, the width (W) of the holes 7 is investigated.

In the case that the center conductor 3 is configured to have a line length of 200 mm, the dielectric substrate 2 is configured to have a relative dielectric constant of 4.4, the holes 7 formed on both sides of the center conductor 3 is configured to have an interval of 5.8 mm, transmission loss in case that the width of the holes 7 was changed was calculated by an arithmetical operation. Further, the other conditions are similar to the case shown in FIG. 3. The result is shown in Table 1.

TABLE 1

| Width of holes | Width of center conductor | Loss (dB) at 2.2 GHz | |
|---|---|---|---|
| W (mm) | Wc (mm) | 200 mm | Per 1 m |
| 0 | 4.4 | 0.149819 | 0.749 |
| 1 | 4.8 | 0.0851196 | 0.426 |
| 2 | 4.8 | 0.0778187 | 0.389 |
| 4 | 4.8 | 0.075366 | 0.377 |
| ∞ | 4.8 | 0.0754 | 0.377 |

As shown in Table 1, in case that the width of the holes 7 is configured to be not less than 4 mm, transmission loss per 1 m becomes almost constant at 0.377 dB. Consequently, in order to sufficiently reduce transmission loss, it is preferable that the width of the holes 7 is configured to be not less than 4 mm.

Figure 5:
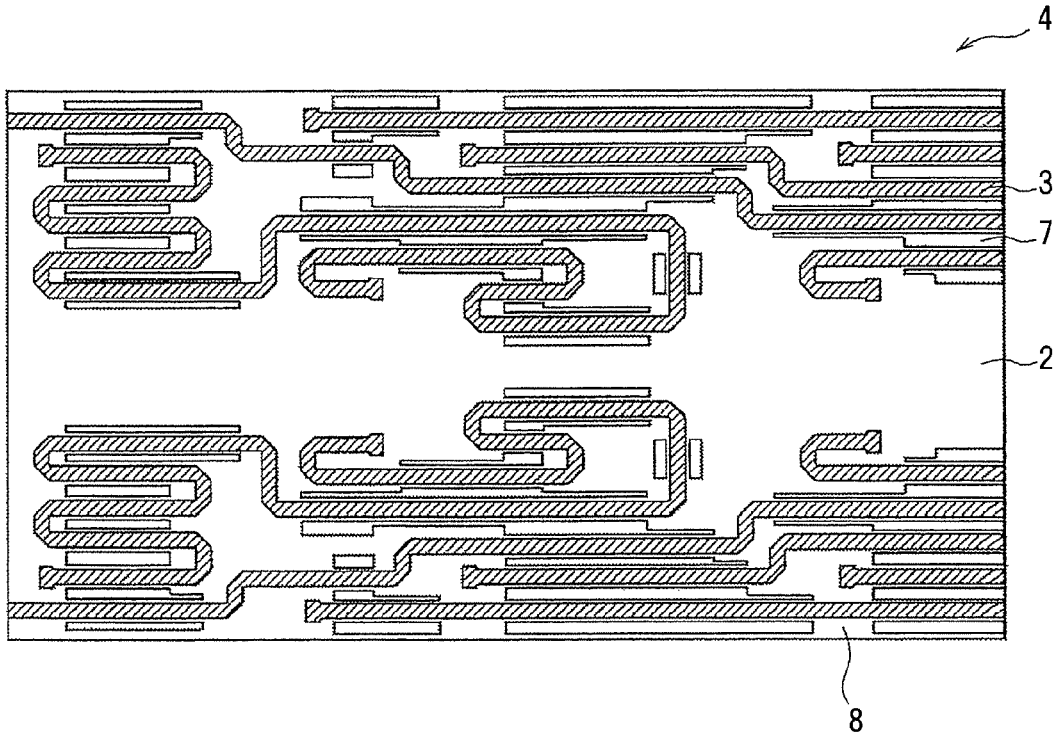
FIG. 5 is a photograph showing an example of the center substrate.

In FIG. 1, for the purpose of simplifying an explanation, a schematic drawing is shown, but the center substrate 4 actually fabricated is configured as, for example, FIG. 5. As shown in FIG. 5, it is difficult to form the holes 7 in a curved part of the center conductor 3, thus it is preferable that the holes 7 are formed on both sides of the center conductor 3 that is linearly shaped. The more the line length of the center conductor 3 is long, the more the effect due to forming the holes 7 is large, thus by applying the invention to the phase shifter distribution line part 10 in which the line length becomes particularly long, a large effect can be obtained.

As explained above, in the antenna device 1, the holes 7 are formed in the dielectric substrate 2 on at least one side of the center conductor 3 along the center conductor 3.

The holes 7 are formed, thereby an electrical field passing through the dielectric substrate 2 is reduced so as to suppress an influence of the dielectric substrate 2, so that transmission loss due to the influence of the dielectric substrate 2 can be reduce in the feeder line 6.

In addition, the holes 7 are formed between the center conductors 3 adjacent to each other, thereby high isolation can be maintained between the center conductors 3 adjacent to each other, even if the center conductors 3 are densely wired.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

For example, in the above-mentioned embodiment, the holes 7 are formed so as to have a rectangular shape in planar view, but the shape of the holes 7 is not limited to this.

What is claimed is:

1. An antenna device, comprising:

a center substrate comprising a dielectric substrate and a center conductor on the dielectric substrate; and two ground plates sandwiching via an air layer the center substrate therebetween to form a feeder line, wherein a hole is formed in the dielectric substrate on at least one side of the center conductor along a longitudinal direction of the center conductor, and wherein the center conductor comprises a wiring pattern formed symmetrically on both surfaces of the dielectric substrate.

2. The antenna device according to claim 1, wherein the hole comprises a through hole penetrating the dielectric substrate.

3. The antenna device according to claim 1, wherein the hole is formed in the dielectric substrate on both sides of the center conductor along the longitudinal direction of the center conductor.

4. The antenna device according to claim 1, wherein a distance between the center conductor and the hole is not more than a thickness of the dielectric substrate.

5. The antenna device according to claim 1, wherein the hole is formed between adjacent ones of the center conductor, and wherein the distance between the center conductor and the hole is not more than 0.3 mm.

6. The antenna device according to claim 1, wherein the hole is not less than 4 mm in width.

* * * * *